US005479917A

United States Patent [19]

Hsieh

[11] Patent Number: 5,479,917

[45] Date of Patent: Jan. 2, 1996

[54] STRUCTURE OF DIVING MASK

[76] Inventor: Hsing-Chi Hsieh, 1 Fl., No.22, Lane 125, Jen Al Street, Sanchung City, Taipei Hsien, Taiwan

[21] Appl. No.: 395,725

[22] Filed: Feb. 28, 1995

[51] Int. Cl.[6] ..... A61F 9/02

[52] U.S. Cl. ..... 128/200.29; 2/428; 2/439; 2/442

[58] Field of Search ..... 128/200.29, 201.11, 128/206.21, 207.13; 2/428, 439, 442

[56] References Cited

U.S. PATENT DOCUMENTS

| | | | |
|---|---|---|---|
| 2,372,824 | 4/1945 | Kish | 128/207.13 X |
| 2,435,653 | 2/1948 | Maurer | 128/207.13 X |
| 2,792,000 | 5/1957 | Richardson | 128/207.13 X |
| 4,846,170 | 7/1989 | McAnalley et al. | 128/207.13 |
| 4,856,120 | 8/1989 | Hart | 2/428 |
| 5,329,643 | 7/1994 | Sato | 2/428 |

FOREIGN PATENT DOCUMENTS

| | | | |
|---|---|---|---|
| 588149 | 1/1978 | U.S.S.R. | 128/200.29 |

*Primary Examiner*—Ren Yan
*Assistant Examiner*—Eric P. Raciti
*Attorney, Agent, or Firm*—Pro-Techtor International

[57] ABSTRACT

The present invention is related to a structure of diving mask wherein a nose notch is formed on the soft skirt of diving mask, a nose slot is provided in a corresponding position on the mask frame can nest the nose notch, a plurality of frame slots are provided around the outer periphery of nose slot to fix a hard nose cover, the bottom of nose cover is provided with a drain valve to drain the water accumulated in the diving mask; and one each flowguide hole is provided on the two sides of nose slot, a flowguide cover covers the exterior of the nose cover and flowguide holes, a flowguide passage is fromed between the interior of flowguide cover and the flowguide holes, so the accumulated water drained out of the drain valve on the nose cover can be guided to flow out to the exterior of the two sides of diving mask through the flowguide holes on the two sides of nose slot in order to avoid disturbing the diver's vision.

2 Claims, 7 Drawing Sheets

STRUCTURE OF DIVING MASK

BACKGROUND OF THE INVENTION

1. Field of the Invention

The present invention is related to a structure of diving mask and particularly to a structure of diving mask with a soft nose so that the diving mask have the effect of both drain and drain flowguide.

2. Description of the Prior Art

The diving mask, as one of the necessary equipment for a diver to dive in deep water or on water surface, can help the diver see the scene clearly in the water so as to protect his or her eyes.

The skirt of diving mask is generally made of soft rubber in order to let the mask naturally and tightly contact the diver's face. However, the pattern of face such as fat, lean, long or short varies with everybody, the mask and the face connot desirably and entirely contact each other, so the water will inevitably and gradually permeat into the mask from where the close contact between the face and the mask leaves much to be desired, and the diver's face is disturbed by the water permeated thereinto. If the water permeated thereinto is too much, the diver's breathing and line of vision will be affected seriously and unfavorably, therefore it is necessary to drain the water accumulated in the mask from time to time during the use of the mask.

Thus the diver has to learn how to drain when learning diving and particularly diving in deep water. In case of the diving mask without any drain valve, the diver uses the first finger to press the upper edge of the mask and then uses the thumb to turn open the lower edge thereof, and meantime blows out the water accumulated in the mask from the opened lower edge thereof through the exhaling action of diver's nose which generates an exhaling pressure. However, such a drain operation is not convenient and the diver has to have a skillful operating skill but those who are beginners or have a poor skill will be inevitably panic psychologically. In another case of the diving mask with a drain valve, the diver can directly blow out the water accumulated in the mask from the drain valve through the exhaling action of the diver, so its use is more convenient.

Nowadays the diving mask are generally classified into two types: i.e. the diving mask with hard nose and the diving mask with soft nose, wherein the diving mask with hard nose (1) as shown in FIGS. 1 and 2 is a monocular type mask comprising a mask frame (11), a sort skirt (12) and a fixed frame (13), wherein the soft skirt (12) with a frame edge (121) is nested behind an inner flange (131) of the fixed frame (13), the mask frame (11) is inserted in the fixed frame (13) to tightly clamp the frame edge (121) of soft skirt (12) in coorperation with the inner flange (131) of the fixed frame (13), and then its combination is finished. The mask frame (11) is provided with a single lens (111), and a frame edge is formed integrally together with a nose (112) which is hard and made of same material as that of the mask frame (11) and can be conveniently provided with a valve hole and a valve seat for mounting a valve flap thereinto to form a drain valve (113). The drain valve (113) can open outward one way only and let the water accumulated in the mask drain outward but prevent the water outside from flowing into the mask. The lens (111) is directly inserted into the mask frame (11) of the hard nose (112), so it is suitable for a monocular lens only but not for a multicular lens and the lens cannot be disassembled or assembled optionally.

The diving mask with soft nose are classified into monocular and binocular types (The latter can be provided with the binocular lens with different diopters in line with the nearsightedness extent of the nearsighted diver). For example, the binocular diving mask (2) with soft nose as shown in FIGS. 3 and 4 comprises a mask frame (21), a soft skirt (22), two lenses (23), (23) and two fixed clamps (24), (24), wherein the soft skirt (22) has two separate frame edges (221), (221), a nose (222) is formed between these two frame edges (221), (221) and made of same soft material as that of the soft skirt (22) which is nested on two separate inner flanges (221), (221) formed by the mask frame (21) respectively through the two separate frame edges (221), (221), then the lenses (23), (23) are disposed in the mask frame (21) and the fixed clamps (24), (24) are nested in the mask frame (21) of which the inner flanges (211), (211) tightly clamp the frame edges (221), (221) of sort skirt (22) and the lenses (23), (23) in cooperation with the mask frame (21), its assembly is finished. In case of monocular type, there are a single lens and a single fixed clamp, the frame edge of soft skirt is nested on the inner flange of mask frame, the lens and fixed clamp are installed therein to finished its assembly. For such a diving mask with monocular or binocular lens, the lenses with different nearsighted diopters can be disassembled or replaced. However, the soft nose of such a diving mask (2) is instable to support an object, a drain valve cannot be directly installed on the soft nose, so its drawback consists in the inconvenient operation of drain.

SUMMARY OF THE INVENTION

In view of the foregoing defects of conventional diving mask, the present inventor has achieved the present invention. The object of the present invention is to offer a structure of diving mask with more than one type of soft nose having a fine effect of both drain and drain flowguide.

The diving mask according to the present invention comprise a soft skirt, a mask frame, at least one lens and at least one fixed clamp, wherein the soft skirt is nested in the mask frame and then the lens and fixed clamp are assembled. It is characterized in a nose notch on the soft skirt to be nested in a nose slot in a corresponding position on the mask frame, a plurality of fixed frame slots on the periphery of nose slot can fix a hard nose cover of which the bottom is provided with a drain valve to drain the water accumulated in the diving mask.

The present invention is further characterized in one each flowguide hole on the two sides of nose slot for catching a flowguide cover to cover the nose cover and flowguide hole which communicates with the interior of flowguide cover, so the water accumulated in the diving mask and drained out of the drain valve of nose cover can flow out to the extrior on the two sides of diving mask from the flowguide holes on two sides of nose notch and will never disturb the diver's vision.

DETAILED DESCRIPTION OF THE PREFERRED EMBODIMENTS

Figure 1:
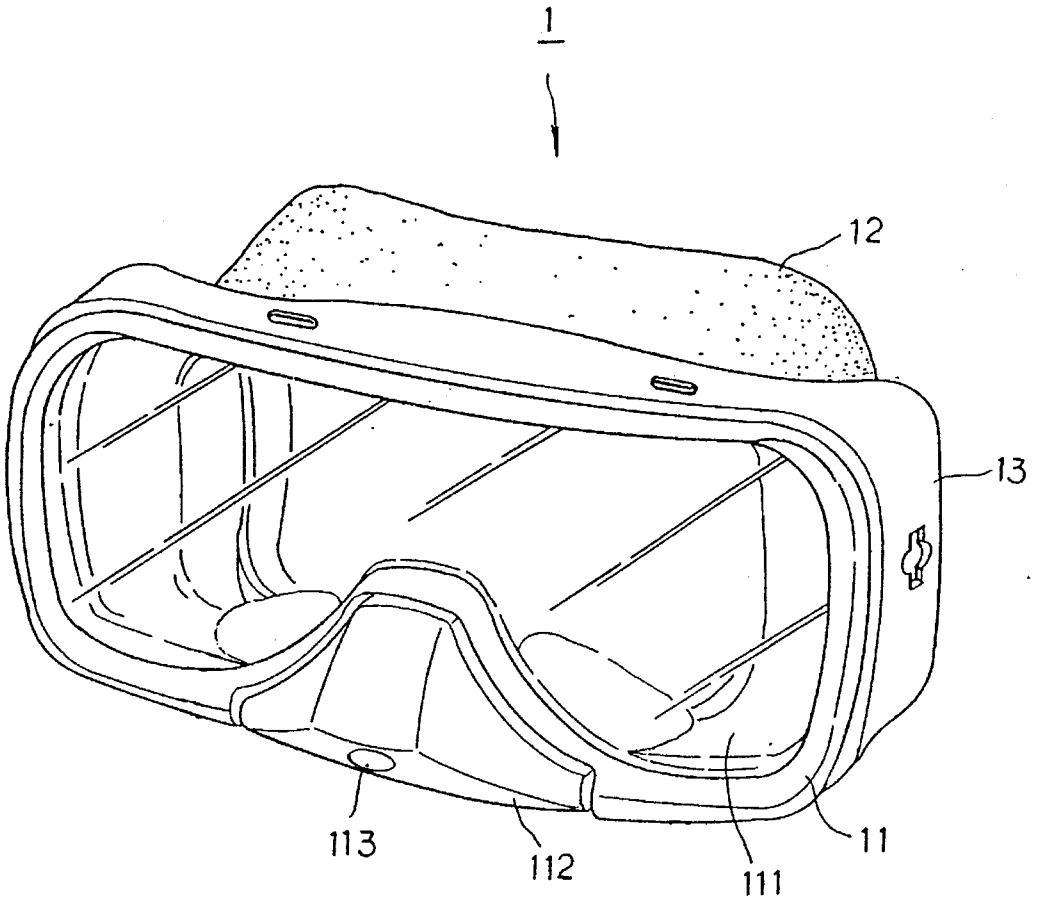
FIG. 1 (Prior Art)
FIG. 1 is an elevational view of conventional diving mask with hard nose.
Figure 2:
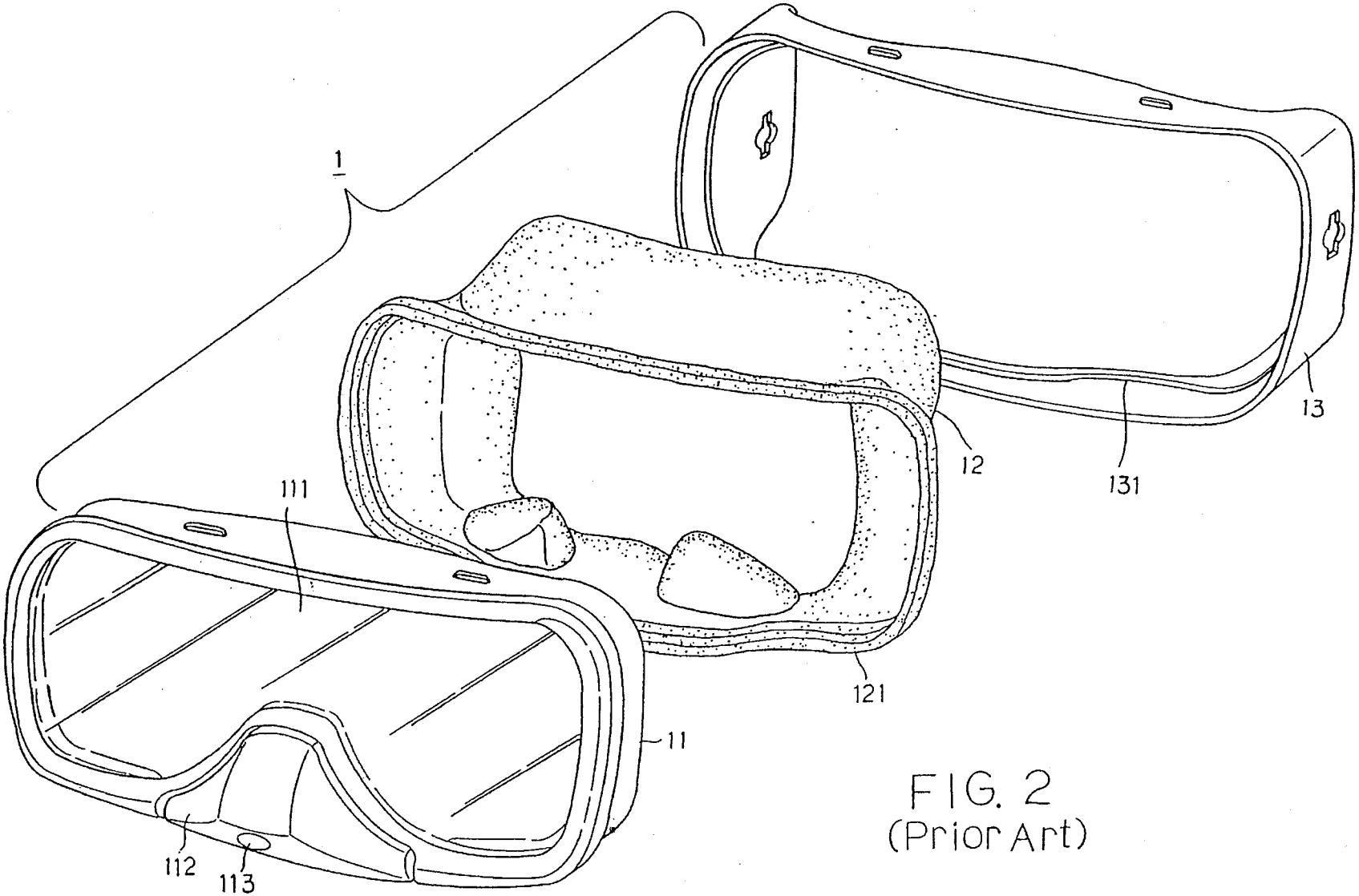
FIG. 2 (Prior Art)
FIG. 2 is a breakdown view of FIG. 1.
Figure 3:
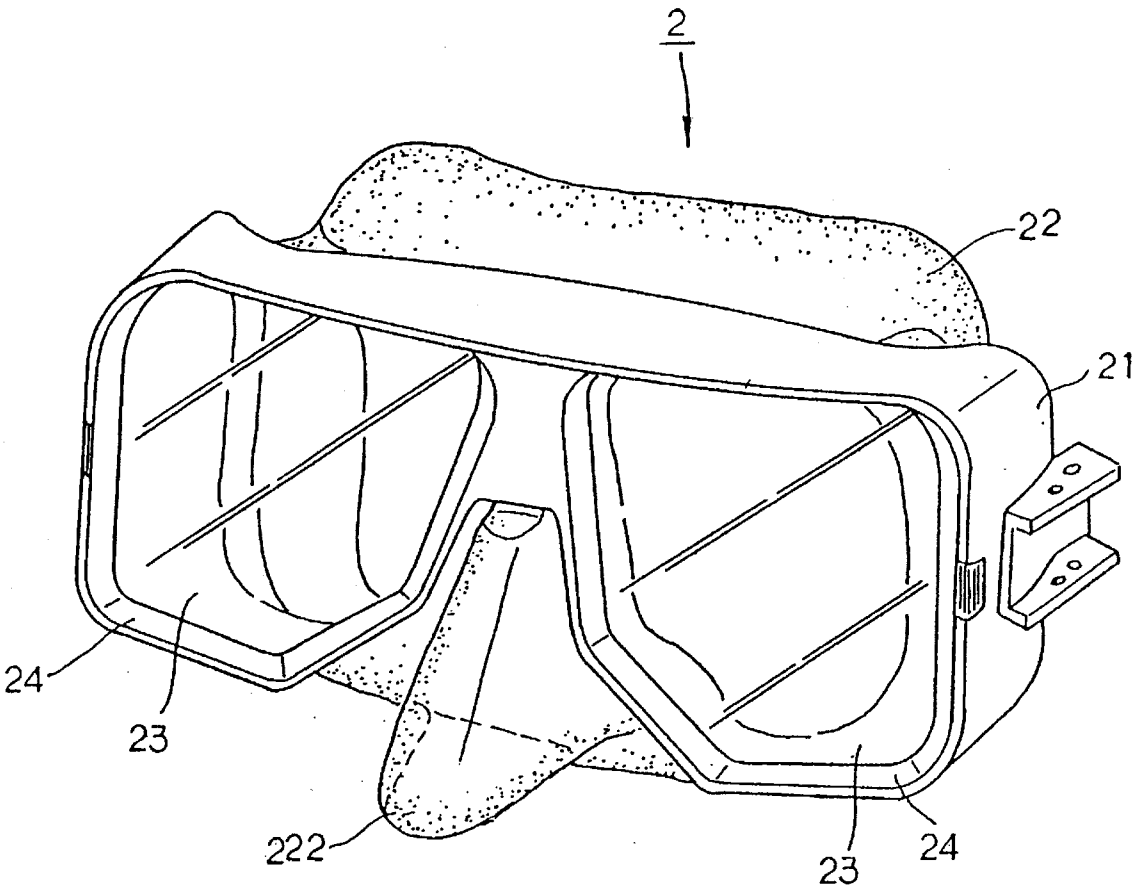
FIG. 3 (Prior Art)
FIG. 3 is an elevational view of conventional diving mask with soft nose.
Figure 4:
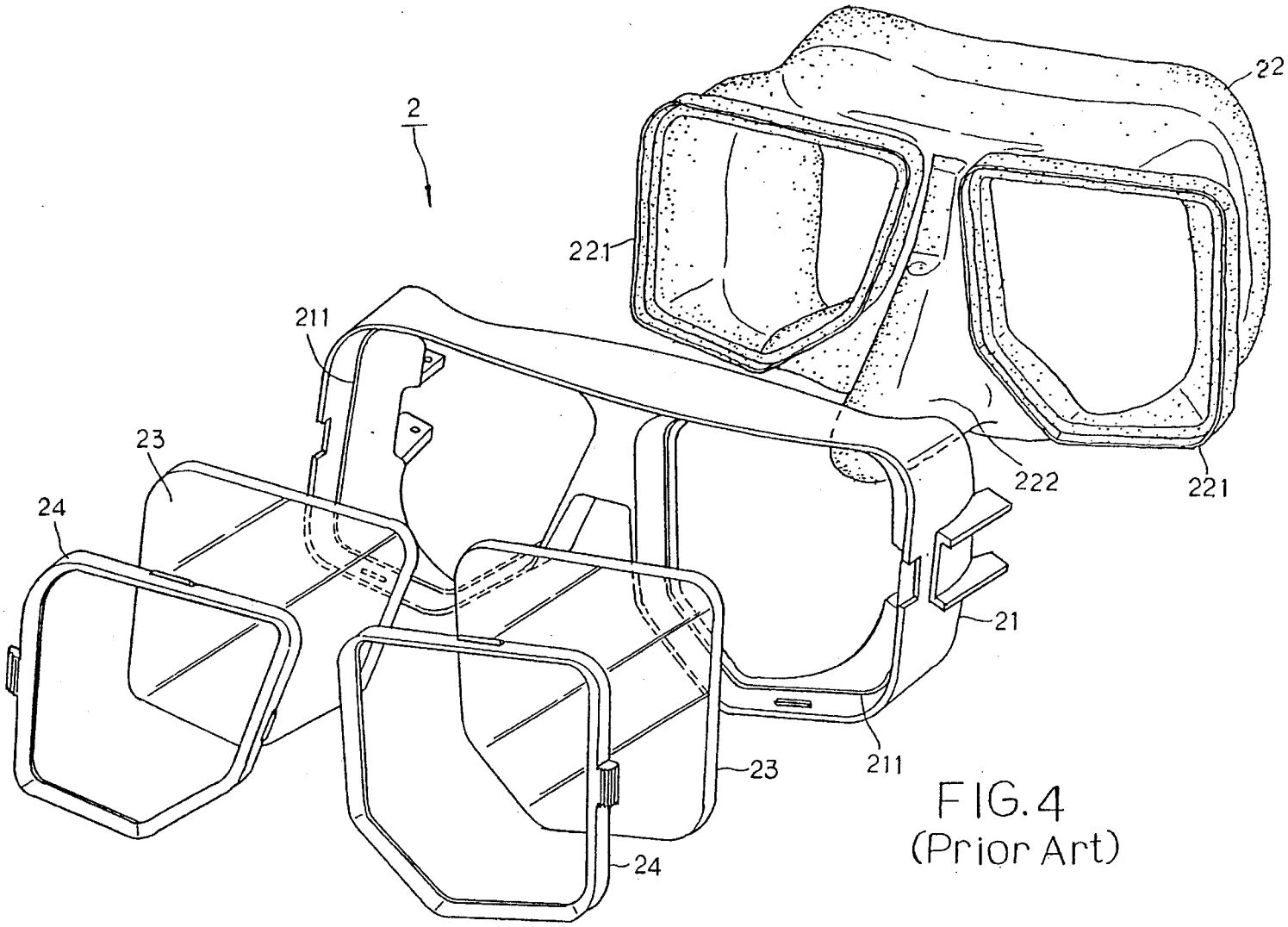
FIG. 4 (Prior Art)
FIG. 4 is a breakdown view of FIG. 3.
Figure 5:
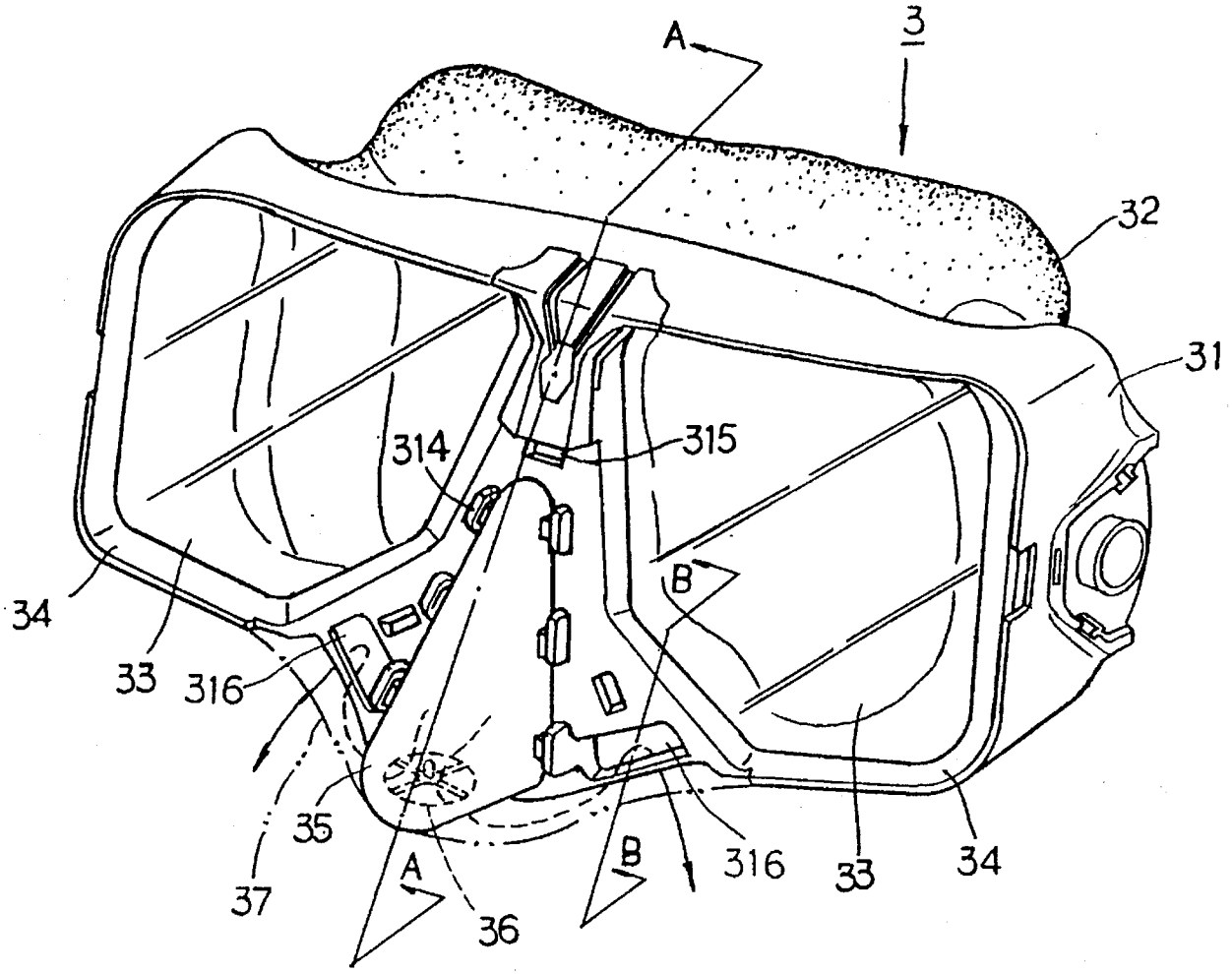
FIG. 5 is an elevational view of diving mask accordong to the present invention.
Figure 6:
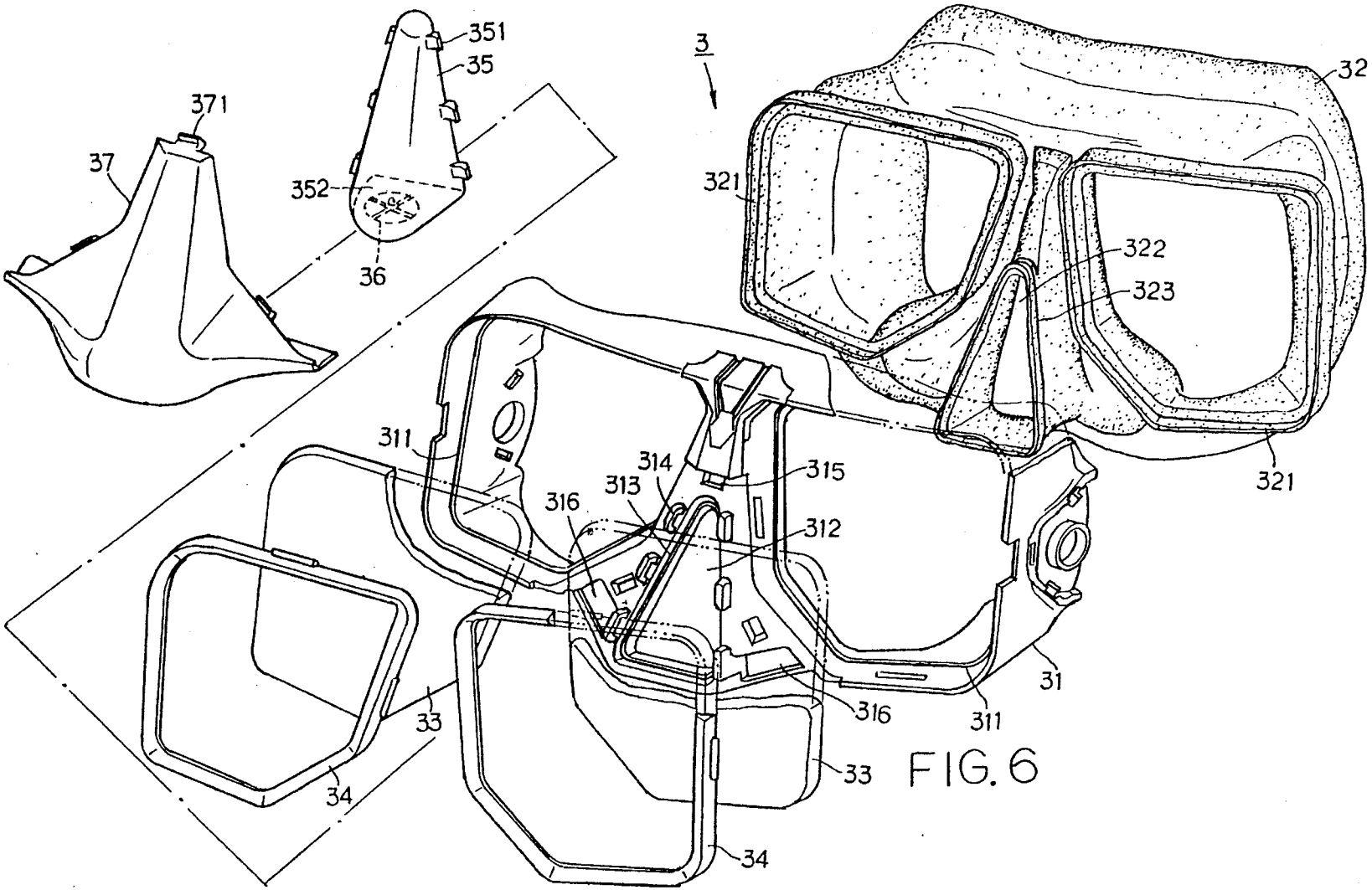
FIG. 6 is a breakdown view of diving mask accordong to the present invention.
Figure 7:
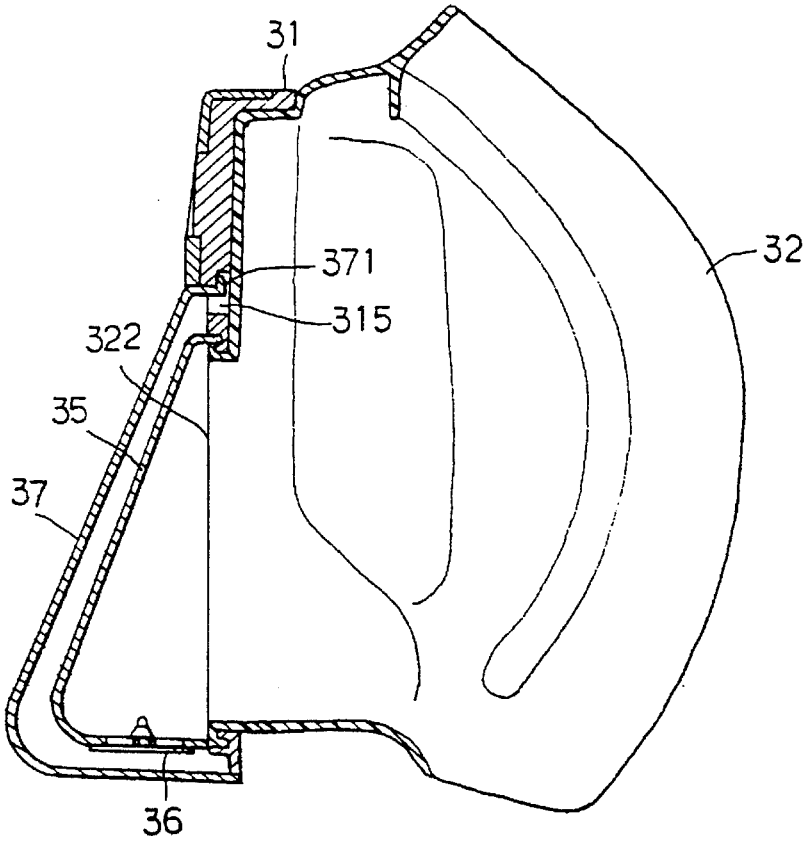
FIG. 7 is a section view along the line A—A of FIG. 5.
Figure 8:
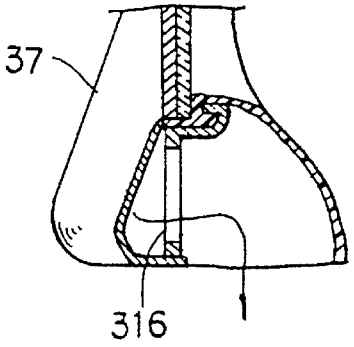
FIG. 8 is a section view along the line B—B of FIG. 5.

The structure, characteristics and function of the present invention are best described in detail in conjunction with the example as shown in the accompanying FIG. 5 to 8 hereinafter.

The diving mask (3) of binocular type according to the present invention comprise a mask frame (31), a soft skirt (32), two lenses (33), (33) and two fixed clamps (34), (34), wherein the mask frame (31) has two separate inner flanges (311), (311), the soft skirt (32) has two separate frame edges (321), (321) to be nested on the two inner flanges (311), (311) of the mask frame (31), and then the lenses (33), (33) and the fixed clamps (34), (34) are installed therein. This is a design of drain and flowguide structure between the soft skirt (32) and the mask frame (31).

As shown in FIGS. 5 to 8, an example of the present invention indicates that a nose notch (322) is formed between the two frame edges (321), (321) of the soft skirt (32), i.e. in the central position of the soft skirt (32) corresponding to the position of diver's nose when he wears the diving mask (3), a frame edge (323) is formed around the outer periphery of the nose notch (322), a nose slot (312) on the mask frame (31) is provided in a position corresponding to the nose notch (322), and an inner flange (313) is formed around the inner periphery of nose slot (312). When the two frame edges (321), (321) of soft skirt (32) are nested on the inner flanges (311), (311) of mask frame (31), and the frame edge (323) of nose notch (322) of soft skirt (32) can also be nested on the inner flange (313) of nose slot (312) of mask frame (31).

A plurality of fixed frame slots (314) are provided around the nose slot (312) of mask frame (31), and a plurality of fixed pieces (351) are provided around a hard nose cover (35) and can be correspondingly and respectively inserted in the fixed frame slote (314) so that the nose cover (35) is fixed in the nose notch (312) to tightly clamp the frame edge (323) of nose notch (322) of nose skirt (32) in cooperation with the inner flange (313) of nose slot (312).

The foregoing nose cover (35) is made of a hard material and a valve hole is provided at the bottom (352) of nose cover (35) for installing a check drain valve (36) capable of opening outward unidirectionally so that the diving mask can achieve a natural effect of drain in line with the diver's exhalation.

A plurality of fixed holes (315) are provided further around the nose slot (312) of mask frame (31), one each flowguide hole (316) is provided on the two sides of nose slot (312), a plurality of catches (371) on the outer edge of a flowguide cover (37) can be caught into these fixed holes (315) respectively so that the flowguide cover (37) covers the exterior of both nose cover (35) and flowguide holes (316), (316), and a flowguide passage is formed between the flowguide holes (316), (316) and the interior of flowguide cover (37).

When the diver wears the diving mask (3) of the present invention for use, his nose is protruding beyond the nose notch (323) of soft skirt (32) and in the nose cover (35). When the water accumulated in the diving mask is too much, the diver can naturally drain the accummlated water through his natural exhalation and the drain valve (36) at the bottom (352) of nose cover (35), and the accumulated water drained through the drain valve (36) is drained out to the exterior on the two sides of diving mask (3) from the flowguide holes (316), (316) on the two sides of nose slot (312) through the guide of inner wall of flowguide cover (37) and will never disturb the diver's vision.

According to the present invention, the nose notch (322) of soft skirt (32) of the diving mask (3) is provided with a nose cover (35) and a check drain valve (36) to achieve the effect of drain, and a flowguide cover (37) and two flowguide holes (316), (316) are provided on the mask frame (31), the flowguide cover (37) covers the exterior of both the nose cover (35) and the flowguide holes (316), (316), so the diving mask (3) has an effect of flowguide against the drained water.

I claim:

1. A diving mask comprising:

a mask frame with an inner flange, a pliable skirt with a frame edge that is received in said inner flange of said mask frame, at least one lens, said lens having an edge received in said inner flange of said mask frame and an edge received on said frame edge of said pliable skirt, at least one fixing clamp that affixes said lens in position in said inner flange of said mask frame and contacting said frame edge of said pliable skirt, and an independent rigid nose cover; wherein a nose notch is formed in a central portion of said pliable skirt, said nose notch corresponding in position to that of a user's nose when said user wears said diving mask, said nose notch includes a frame edge formed around the periphery of said nose notch, a nose slot is formed in a central portion of said mask frame, said nose slot corresponding in position to that of said nose notch of said pliable mask, said nose slot includes an inner flange formed around an inner periphery of said nose slot, said inner flange receives said frame edge of said nose notch, and said rigid nose cover includes projections that are received in fixing slots in said mask frame, a bottom of said rigid nose cover includes a one-way drain valve at a location corresponding to that of the user's nostrils, such that said one-way drain valve is actuated by the user's exhalations.

2. The diving mask of claim 1 wherein:

said mask includes a flowguide cover, said flowguide cover includes projections that are received in fixing holes in said mask frame, and said mask frame includes a flowguide hole on each side of said nose slot; whereby said flowguide cover covers said rigid nose cover and said flowguide holes, thereby establishing flowguide passages between said flowguide holes and an interior side of said flowguide cover.

* * * * *